United States Patent [19]

Hudson et al.

[11] 4,255,092

[45] Mar. 10, 1981

[54] HYDRAULIC VARIABLE-DISPLACEMENT AXIAL PISTON PUMP HAVING TORQUE LIMITATION

[75] Inventors: John A. Hudson, Highworth; Nicholas A. James, Kingswood; Edward G. Morley, Charlton, all of England

[73] Assignee: Plessey Handel und Investments AG, Zug, Switzerland

[21] Appl. No.: 948,213

[22] Filed: Oct. 3, 1978

[30] Foreign Application Priority Data

Nov. 24, 1977 [GB] United Kingdom ..... 48887/77

[51] Int. Cl.[3] ..... F04B 1/26

[52] U.S. Cl. ..... 417/222

[58] Field of Search ..... 417/218, 219, 220, 221, 417/222; 60/451, 452

[56] References Cited

U.S. PATENT DOCUMENTS

| | | | |
|---|---|---|---|
| 2,835,228 | 5/1958 | Parr et al. | 417/222 X |
| 3,864,063 | 2/1975 | Martin | 417/222 |
| 3,873,240 | 3/1975 | Leduc et al. | 417/222 |

*Primary Examiner*—Carlton R. Croyle
*Assistant Examiner*—Edward Look
*Attorney, Agent, or Firm*—Fleit & Jacobson

[57] ABSTRACT

A hydraulic variable-displacement axial piston pump comprising a swash means which tends to move to a de-swashed condition when the pump is working, and a torque limiting device, the torque limiting device comprising a piston and cylinder arrangement having a movable member which when extended acts via the swash means to increase the displacement of the pump, a spool, and a spring which has one end acting on the spool and its other end acting on the movable member thereby placing the spool under a spring load which varies with the extension of the movable member, the spool being coupled to pump delivery pressure at its end remote from the spring and the spool being arranged to control the flow of fluid to the movable member, whereby a limitation on the on-swash condition of the swash means is obtained which is inversely proportional to the pressure at which the hydraulic fluid is discharged from the pump.

4 Claims, 5 Drawing Figures

HYDRAULIC VARIABLE-DISPLACEMENT AXIAL PISTON PUMP HAVING TORQUE LIMITATION

This invention relates to a hydraulic variable-displacement axial pump having torque limitation.

Hydraulic variable-displacement axial piston pumps are well known. There is a need for such a pump to be provided with torque limitation to limit to a predetermined maximum the input torque required by a motor to drive the pump.

It is an aim of the present invention to provide such a pump and accordingly there is provided a hydraulic variable-displacement axial piston pump comprising a swash means which tends to move to a de-swashed condition when the pump is working, and a torque limiting device, the torque limiting device comprising (1) a piston and cylinder arrangement having a movable member which when extended acts via the swash means to increase the displacement of the pumo, (2) a spool, and (3) a spring which has one end acting on the spool and its other end acting on the movable member thereby placing the spool under a spring load which varies with the extension of the movable member, the spool being coupled to pump delivery pressure at its end remote from the spring and the spool being arranged to control the flow of fluid to the movable member, whereby a limitation of the on-swash condition of the swash means is obtained which is inversely proportional to the pressure at which the hydraulic fluid is discharged from the pump.

Usually, the swash means will be a swash plate.

Preferably, the spool has a band for temporarily blocking passages enabling hydraulic fluid to push the movable member to its swash-increasing position. Usually the movable member in the piston and cylinder arrangement will be the piston. It is to be appreciated however that the piston can be fixed and the cylinder arranged to move.

An embodiment of the invention will now be described solely by way of example and with reference to the accompanying drawings in which.

Figure 1:
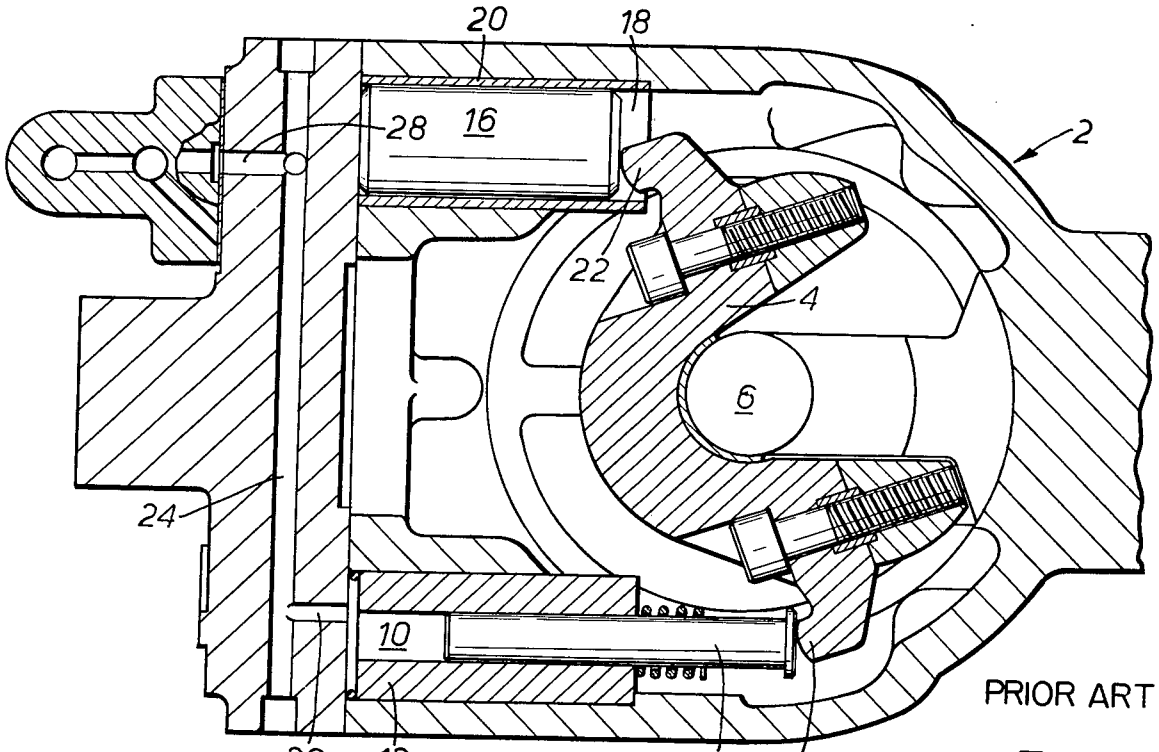
PRIOR ART FIG. 1.
FIG. 1 is a cross section through a known hydraulic axial piston pump.
Figure 2:
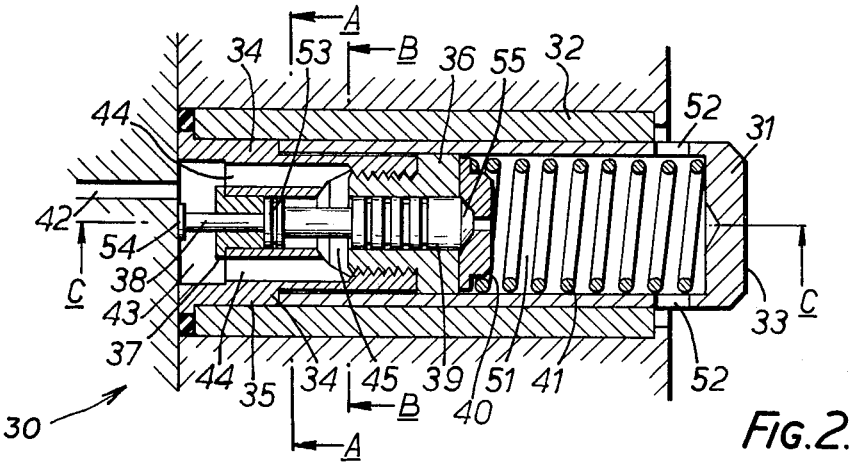
FIG. 2 is an axial section through a torque limiting device for replacing the on-swash piston and cylinder arrangement shown in FIG. 1.
Figure 5:
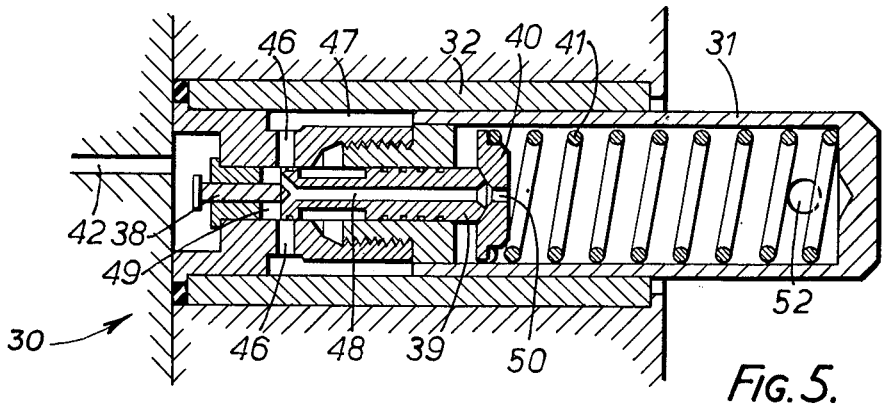
FIG. 5 is an axial cross section on the line C—C shown in FIG. 2 with the piston in a different position.
Figure 3:
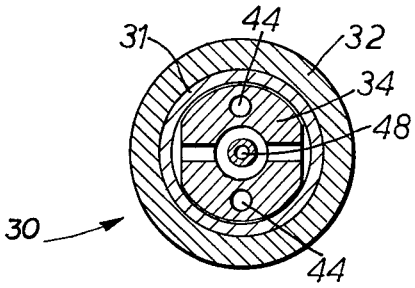
FIG. 3 is a cross-section on the line A—A shown in FIG. 2.
Figure 4:
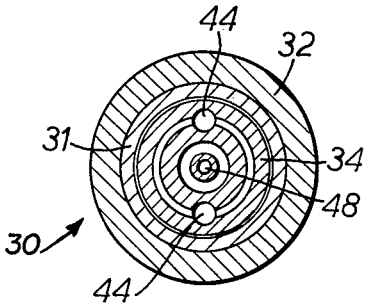
FIG. 4 is a cross section on the line B—B shown in FIG. 2.

Referring to FIG. 1, there is shown a hydraulic pump 2 comprising a swash plate 4 which pivots about a pivot 6. A piston 8 moves in and out of a bore 10 in a cylinder 12. The piston 8 engages an abutment 14 to move the swash plate 4 to an on-swash condition. A piston 16 moves in and out of a bore 18 in a cylinder 20. The piston 16 engages an abutment 22 and moves the swash plate 4 to a de-swashed condition. Fluid is passed to the bores 10, 18 by various conduits, some of which are shown at 24, 26 and 28. The pump 2 is well known and its detailed construction and operation will be readily appreciated by persons skilled in the art.

Referring now to FIGS. 2 to 5, there is shown a torque-limiting device 30 which can be employed to replace the piston and cylinder arrangement 8, 12 shown in FIG. 1. It is to be appreciated however that the torque-limiting device can also be employed in a pump that does not have the piston and cylinder arrangement 16, 20 since this piston and cylinder arrangement 16, 20 only acts to provide an over-ride function for the pump 2 for over-riding the torque-limiting device 30 and this over-ride function may not always be desired.

The torque-limiting device 30 comprises a piston 31 which is constrained to slide axially within a cylinder 32, this cylinder being rigidly fitted to the body of the pump 2, for example by being press fitted in position. The piston 31 contacts the pump swash plate 4 with its face 33 such that movement of the piston 31 out of the cylinder 32 causes the swash plate to move such that the displacement of the pump 2 is essentially proportional to the travel of the piston 31.

The cylinder 32 contains a spool housing assembly 34. The assembly 34 is made up of two parts 35 and 36 which are rigidly assembled together, for example by screwing. The part 35 is rigidly assembled to the cylinder 32, for example by being press fitted into position. The larger diameter of the part 36 fits closely within the hollow piston 31. The spool housing assembly 34 carries a fixed guide 37 which can again be pressed in position. The guide 37 contains a plunger 38 and the plunger 38 is free to slide axially within the guide 37.

One end of the plunger 38 contacts a spool 39. The spool 39 is free to slide axially within the housing assembly 34. The spool 39 in turn contacts a spring carrier 40 which positions a spring 41 between the carrier 40 and the inner end of the hollow piston 31. The load exerted by the spring 41 varies inversely as its length and this length increases as the piston 31 moves out of the cylinder 32 and the pump displacement increases. Therefore the load exerted by the spring 41 varies in inverse proportion to the displacement of the pump 2.

The spool 39 incorporates an internal passageway 48 connecting the volume 49 via passages 50 in the spring carrier 40 and volume 51 in the piston 31 through passages 52 to the interior of the pump body at low pressure.

Under the forces imposed by the pumping action, the swash plate 4 tends to move to the minimum displacement condition, thus forcing the piston 31 back into the cylinder 32. This loads the spring 41 to position the spool 39, the carrier 40 and the plunger 38 as shown in the drawings.

Pump delivery pressure is sensed by the control device via internal passages within the pump 2, the last one being the passage 42. Fluid also passes from the chamber 43 via passages 44 to a chamber 45 and thence via passages 46 into an annular chamber 47, thus acting on the annular end of the piston 31.

If the delivery pressure rises, a point will be reached whereby the force on the end 54 of the plunger 38, which is transmitted to the spring 41 via the spool 39 and the spring carrier 40, will overcome the force exerted by the spring 41 and will cause the plunger 38, the spool 39 and the spring carrier 40 to move to the right. This motion will cause a land 53 on the spool 39 to initially cover the passages 46, thus cutting off the supply of fluid to the chamber 47, and to then connect the chamber 47 to the pump case via the passages 46, 49, 48, 50, 51 and 52. Thus the force from the fluid pressure on the piston 31 is destroyed and the piston 31 will move back into the cylinder 32 under the de-swashing action of the pump 2. This movement will compress the spring 41, which will thus exert a higher load on the end 55 of the spool 39, thus returning the spool 39 to its original position, and restoring the pressure in the annular chamber 47 and hence forcing the piston 31 out of the cylinder 32 once more.

An equilibrium condition is thus attained whereby for a given position of the piston 31, and hence a given value of pump displacement, a maximum pressure may be reached which is inversely proportional to the pump displacement before the pump 2 is allowed to de-swash and then achieve equilibrium at a lower displacement and higher pressure.

It is to be appreciated that the embodiment of the invention described above has been given by way of example only and that modifications may be effected. Thus, for example, the torque-limiting device shown in FIGS. 2 to 5 can be used in a pump 2 which does not have piston and cylinder arrangement 16, 18 as indicated above.

What we claim is:

1. A hydraulic variable displacement axial piston pump comprising a swash means which tends to move to a de-swashed condition when the pump is working, and a torque-limiting device, the torque limiting device comprising (1) a piston and cylinder arrangement having a movable member which when extended acts via the swash means to increase the displacement of the pump, (2) a spool, and (3) a spring which has one end acting on the spool and its other end acting on the movable member thereby placing the spool under a spring load which varies with the extension of the movable member, the spool being coupled to pump delivery pressure at its end remote from the spring and the spool being arranged to control the flow of fluid to the movable member, whereby a limitation of the on-swash condition of the swash means is obtained which is inversely proportional to the pressure at which the hydraulic fluid is discharged from the pump, the spool being movable between a first position in which the spool blocks fluid flow to the movable member and a second position permitting fluid flow to the movable member, the spool being urged towards the second position by the spring and being urged towards the first position by pump delivery pressure, said swash means moving towards the de-swashed condition when said spool is in said first position to thereby compress said spring so that an increased force is exerted on the spool by the spring.

2. A piston pump according to claim 1 in which the swash means is a swash plate.

3. A piston pump according to claim 2 in which the spool has a band for temporarily blocking passages enabling hydraulic fluid to push the movable member to its swash-increasing position.

4. A piston pump according to claim 3 in which the movable member in the piston and cylinder arrangement is the piston.

* * * * *